US005738539A

United States Patent [19]

Caveney et al.

[11] Patent Number: 5,738,539

[45] Date of Patent: Apr. 14, 1998

[54] CONNECTOR MOUNTING RECEPTACLE

[76] Inventors: Jack Edward Caveney, 546 Dalewood La., Hinsdale, Ill. 60521; Dale Alan Block, 2325 Grand Ave., Schererville, Ind. 46375; Karl Erik Falkstrom, 1415 Partridge La., #5, Arlington Heights, Ill. 60004; Kris B. Lindley, 11421 Kluth Dr., Mokena, Ill. 60448; Michael Joseph McGrath, 1635 Pine Rd., Homewood, Ill. 60430; Walter John Moehle, 908 White La., New Lenox, Ill. 60451

[21] Appl. No.: 802,174

[22] Filed: Feb. 14, 1997

Related U.S. Application Data

[62] Division of Ser. No. 493,439, Jun. 22, 1995, Pat. No. 5,672,074.

[51] Int. Cl.[6] ..... H01R 13/60

[52] U.S. Cl. ..... 439/535

[58] Field of Search ..... 439/540.1, 535, 439/676

[56] References Cited

U.S. PATENT DOCUMENTS

| | | | |
|---|---|---|---|
| 3,335,248 | 8/1967 | Bassani | 174/53 |
| 3,812,281 | 5/1974 | Boyer | 439/561 |
| 4,406,509 | 9/1983 | Jagen | 439/354 |
| 4,875,872 | 10/1989 | Tanaka | 439/344 |
| 4,875,881 | 10/1989 | Caveney et al. | 439/535 |
| 4,883,432 | 11/1989 | Reed | 439/553 |

*Primary Examiner*—Neil Abrams

*Assistant Examiner*—T. C. Patel

*Attorney, Agent, or Firm*—Mark D. Hilliard; Robert A. McCann; Michael J. Turgeon

[57] ABSTRACT

Connector mounting receptacles include either a mounting base or a wall plate having a spaced apart tooth and resilient latch disposed to engage mounting slots in a modular connector to releasably mount the connector to the receptacle. The connector includes corner mounting slots disposed to engage lateral stops formed in the wall plate. Steel wall plate receptacles are integrally formed of conductive metal with the connector latching features being configured to concurrently releasably latch and conductively ground a shielded connector mounted in the receptacle.

2 Claims, 24 Drawing Sheets

CONNECTOR MOUNTING RECEPTACLE

This is a divisional of application Ser. No. 08/493,439, filed Jun. 22, 1995, now U.S. Pat. No. 5,672,074.

TECHNICAL FIELD

The present invention relates generally to receptacles for releasably mounting modular electrical connectors.

BACKGROUND ART

Although many different connector mounting receptacles have been proposed, there is a continuing need to reduce the size of the modular connectors to provide more connectors in a smaller area, thus there is a need for improved receptacles that can securely but releasably mount modular connectors of smaller sizes in close proximity while providing easy removal and replacement of the connectors, since none of the prior receptacles yet has provided the best combination of features and manufacturing economy there is still need for improvement in the art.

SUMMARY OF THE INVENTION

It is the object of the present invention to provide improved modular connector mounting receptacles that can securely mount one or more modular electrical connectors in each receptacle such that the connector can be released from the receptacle and replaced with a different connector as desired.

It is another object of the present invention to provide improved modular connector mounting receptacles that can releasably mount smaller connectors in higher densities.

It is a further object of the present invention to provide a receptacle formed of a conductive metal that concurrently releasably latches and grounds a shielded connector to the receptacle when the connector is latched thereto.

It is an additional object of the present invention to provide improved modular connector mounting receptacles that are simple and economical to manufacture.

In general a base receptacle for mounting a modular connector having front and rear mounting slots disposed on front and back surfaces of the connector includes a planar base; latch means integrally formed in the base for releasably securing the connector to the base including a front latch tooth formed in the base disposed to engage the front mounting slot of the connector, a resiliently mounted rear latch tooth formed on a latch wall aligned with and spaced from the front latch tooth such that the rear latch tooth is disposed to engage the rear mounting slot of the connector secured by the latch means, the latch wall formed at the end of and perpendicular to a resilient cantilever base arm formed in the plane of the base, wherein the rear tooth is disposed to resiliently latch the connector to the base such that the connector can be released from the base by rotating the latch wall away from the connector to disengage the rear latch tooth from the rear slot in the connector.

A receptacle wall plate assembly includes a connector mounting receptacle having an aperture with spaced apart first and second edges for receiving and mounting a connector, including a resilient connector engaging latch formed adjacent the first edge, a connector engaging tooth formed adjacent the second edge and spaced apart lateral stops formed adjacent the latch in lateral corners of the aperture; and a connector having a slot means formed adjacent a first edge of a front face of the connector for engaging the tooth formed on the second edge of the aperture and spaced apart corner slots formed in adjacent corners of the front face of the connector, inset from the front face of the connector and disposed to receive the lateral stops of the connector mounting receptacle when the connector is latched to the receptacle.

A metal wall plate receptacle includes a one piece conductive metal body with an aperture formed in a substantially planar face, the aperture including spaced apart first and second edges for receiving and mounting a connector, including a resilient cantilever connector engaging latch projecting substantially perpendicular from the face adjacent the first edge of the aperture, and a connector engaging tooth formed in the second edge.

DESCRIPTION OF THE PREFERRED EMBODIMENT

Figure 9:
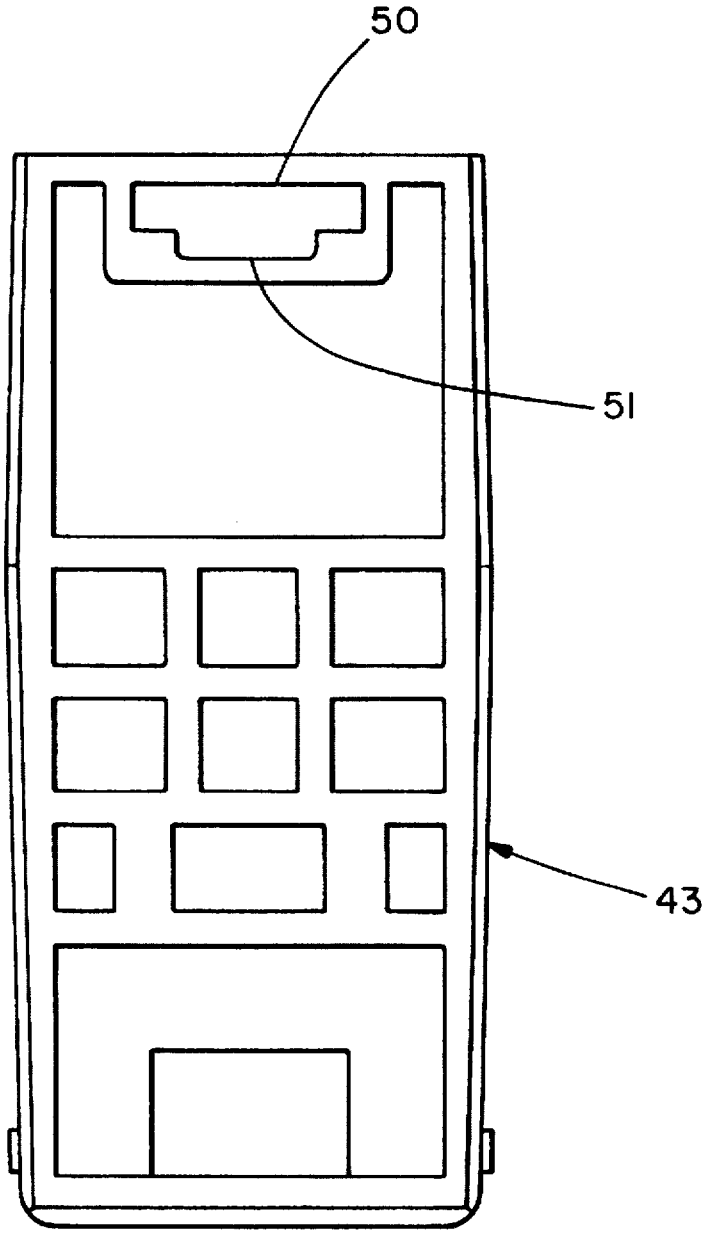
FIG. 9 is a bottom view of the connector of FIG. 7.
Figure 10:
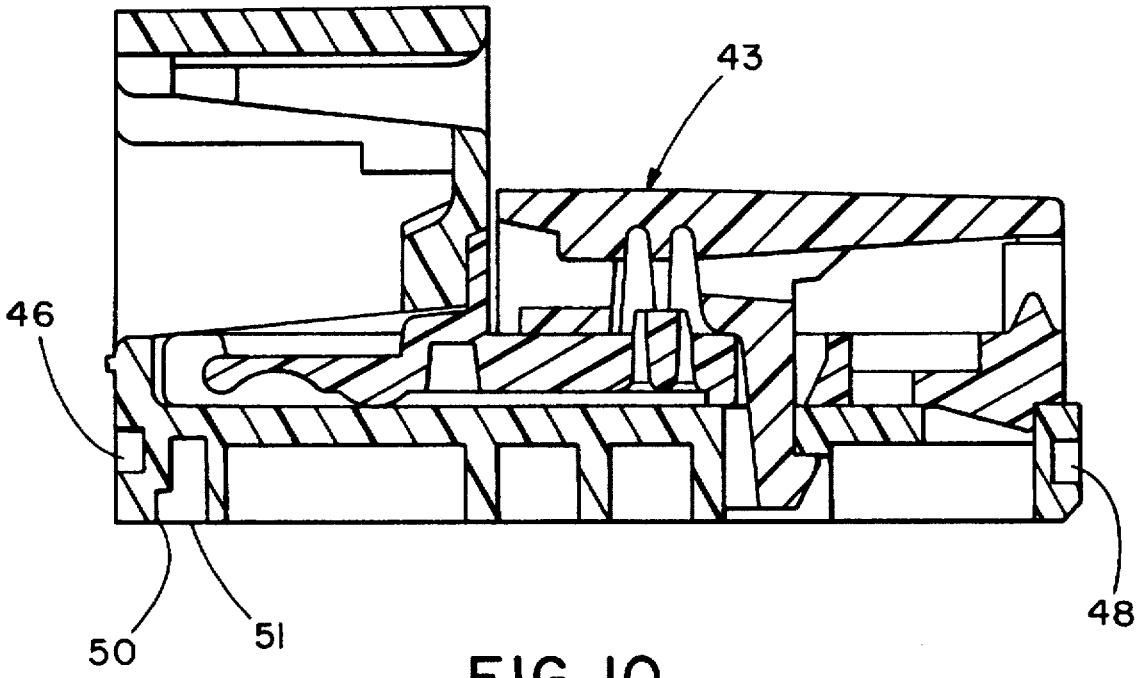
FIG. 10 is a sectional view of the connector of FIG. 7.
Figure 11:
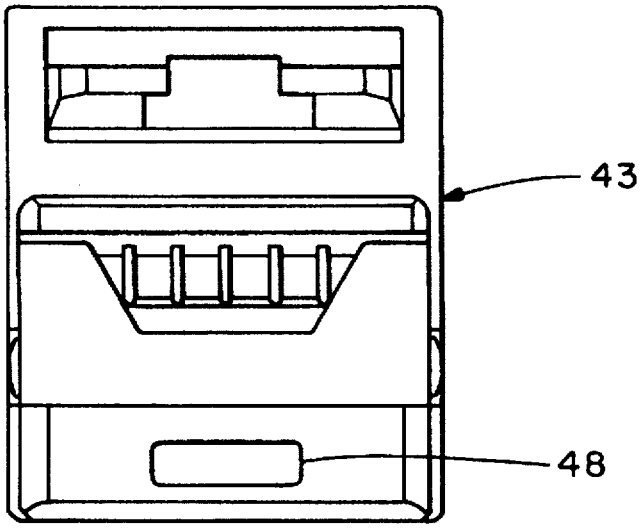
FIG. 11 is a rear view of the connector of FIG. 7.
Figure 12:
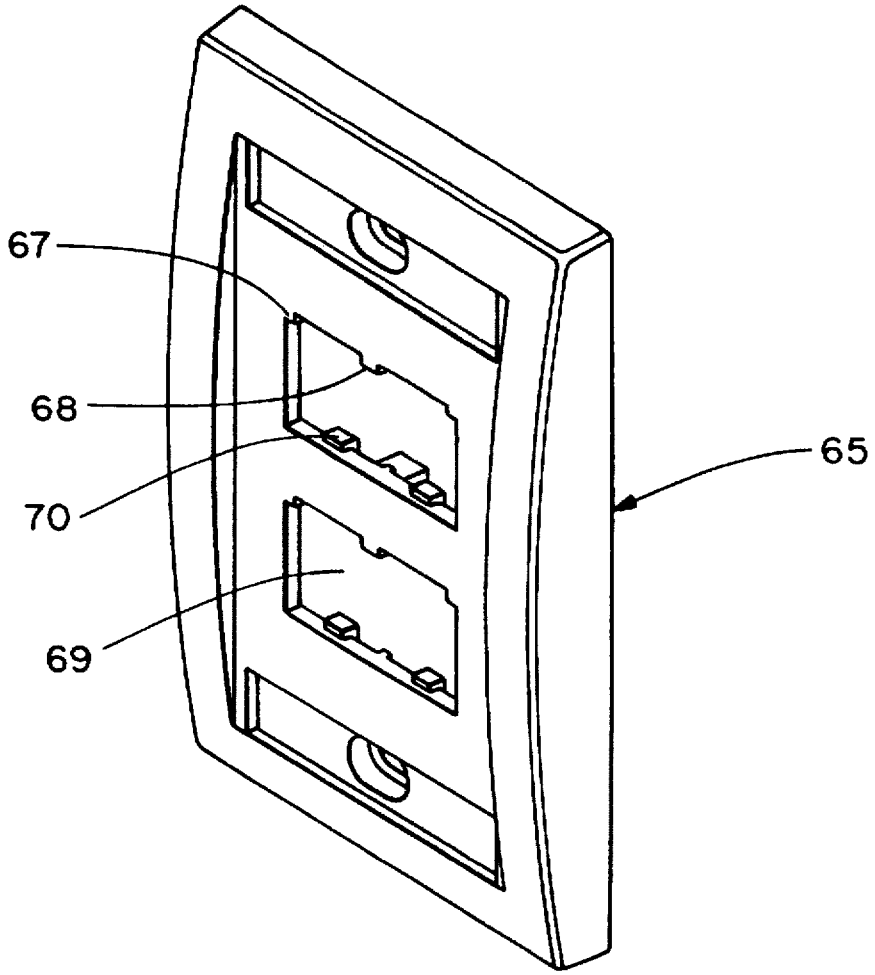
FIG. 12 is a perspective view of a wall plate receptacle embodying the concept of the present invention.
Figure 13:
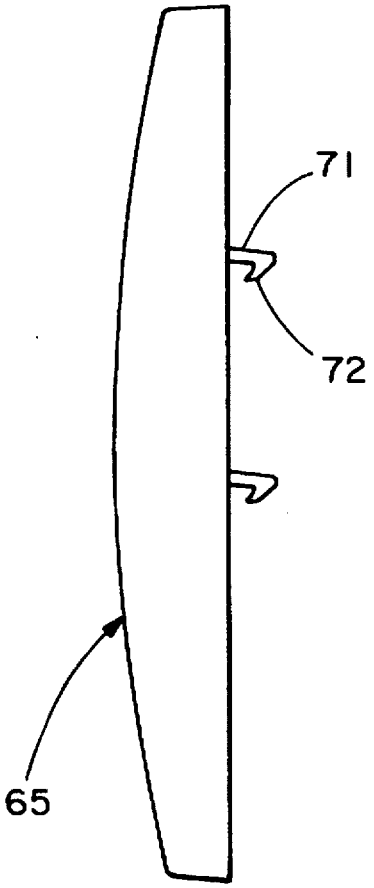
FIG. 13 is a side view of the wall plate of FIG. 12.
Figure 14:
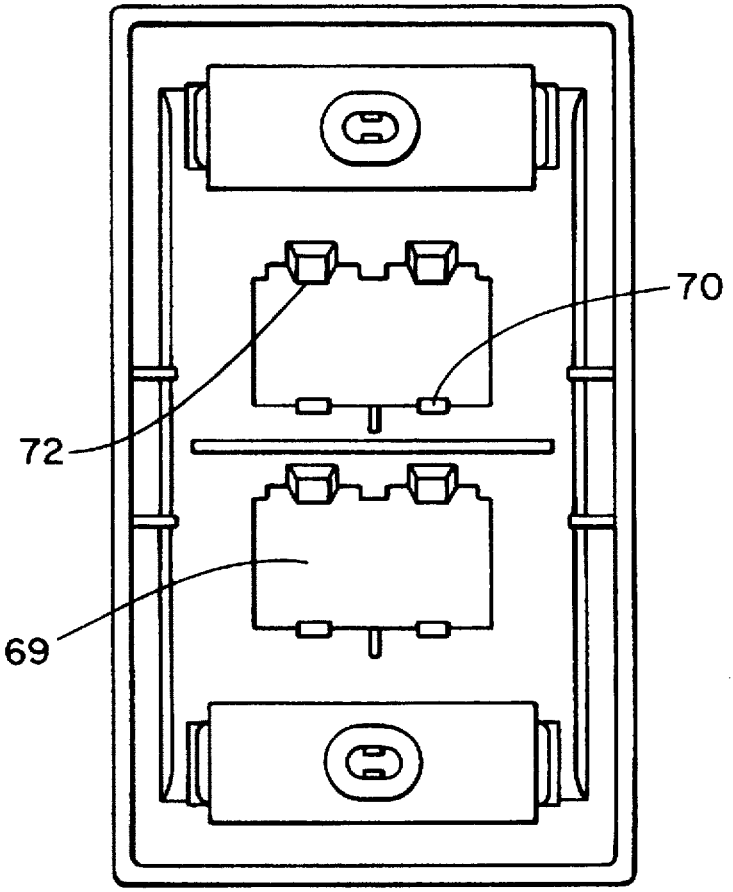
FIG. 14 is a rear view of the wall plate of FIG. 12.
Figure 15:
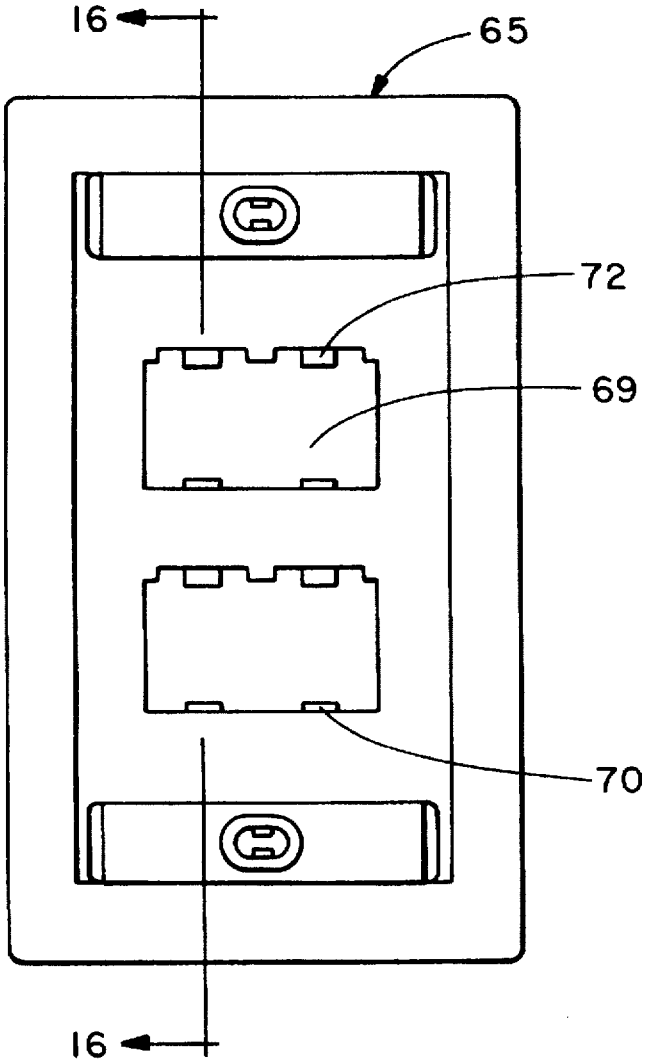
FIG. 15 is a front view of the wall plate of FIG. 12.
Figure 16:
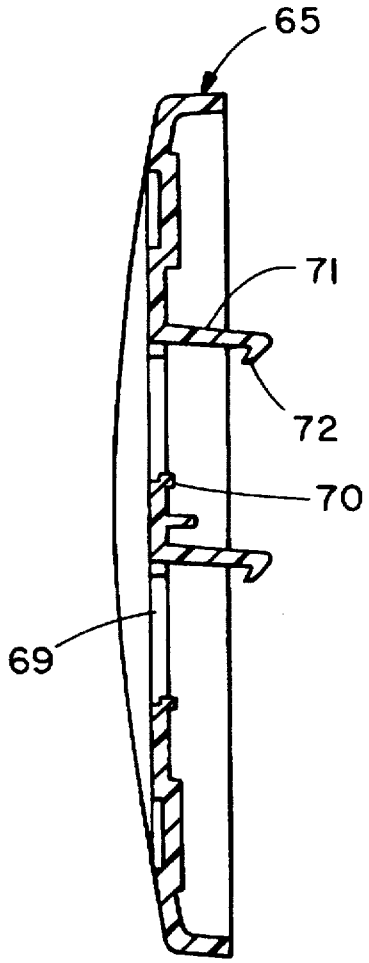
FIG. 16 is a sectional view taken along line 16—16 of FIG. 15.
Figure 17:
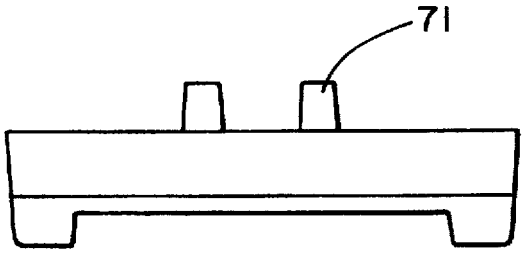
FIG. 17 is a top view of the wall plate of FIG. 12.
Figure 19:
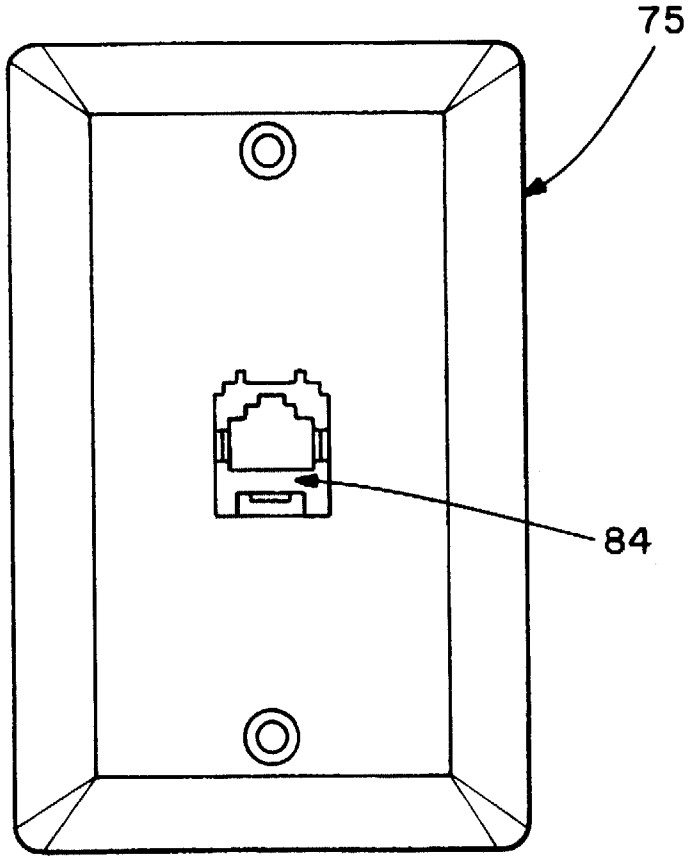
FIG. 19 is a front view of the metal wall plate of FIG. 18 shown with a connector latched to the wall plate.
Figure 18:
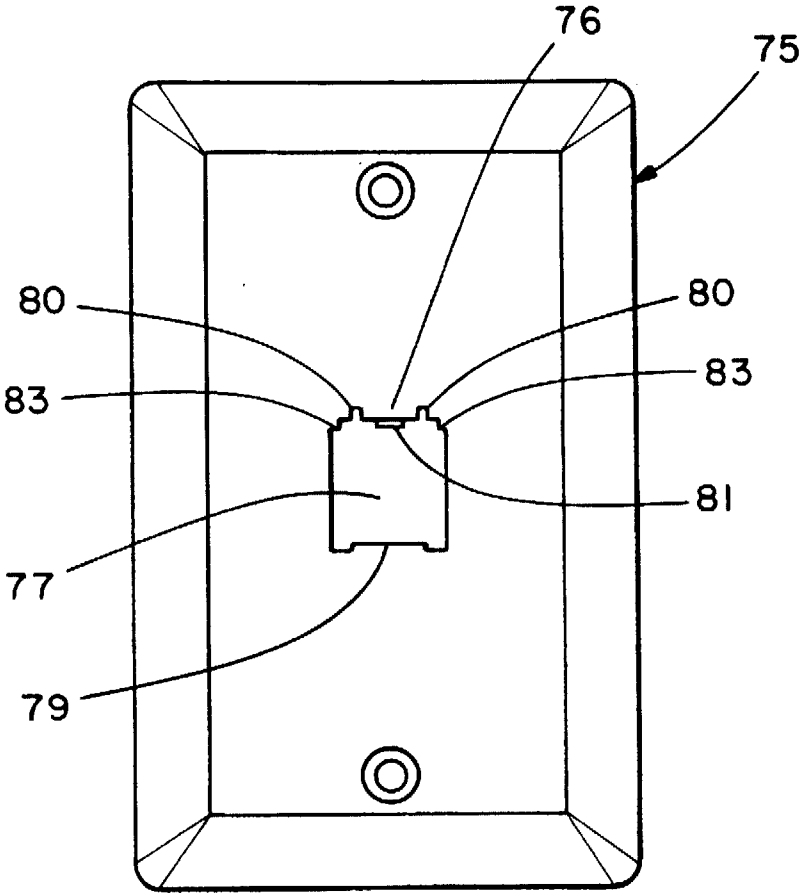
FIG. 18 is a front view of a metal wall plate receptacle embodying the concept of the present invention.
Figure 20:
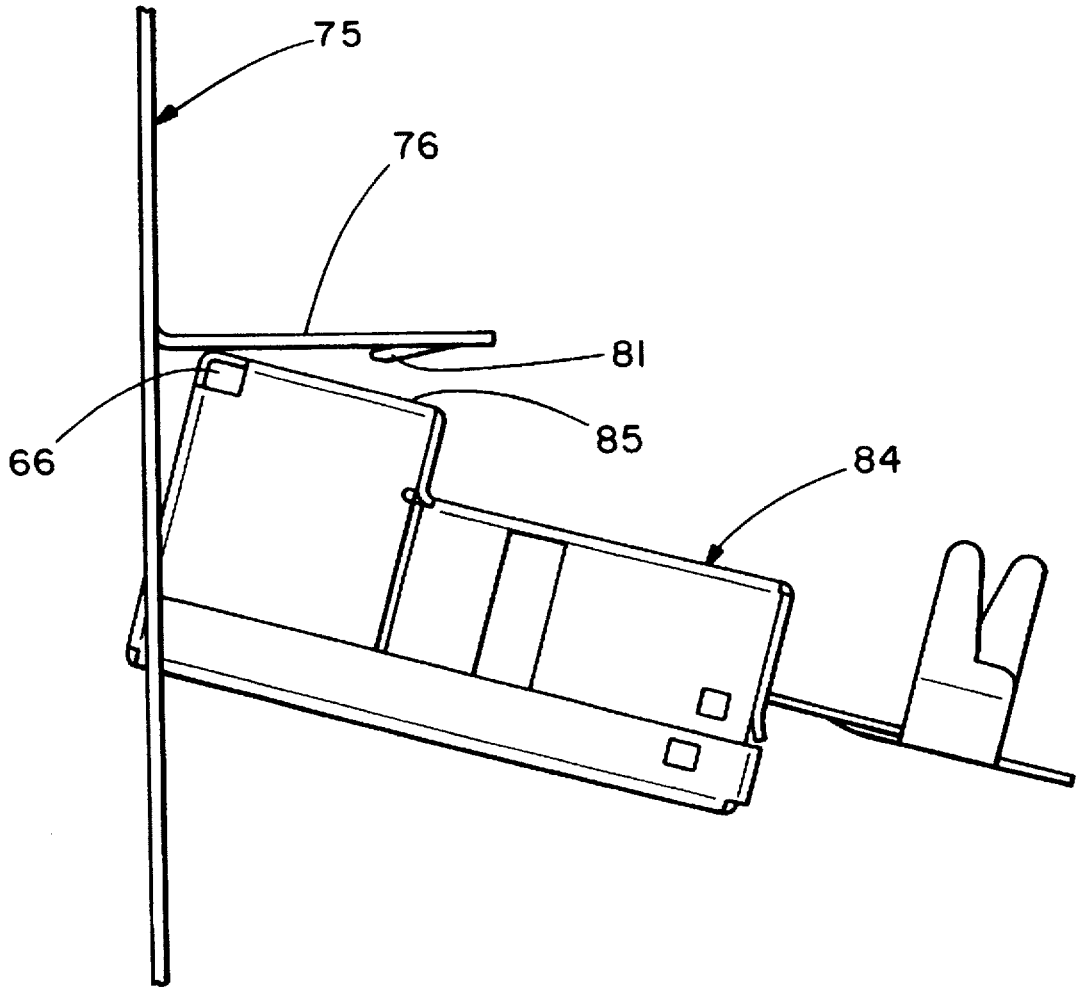
FIG. 20 is a fragmentary side view of metal wall plate of FIG. 18 showing the initial connector insertion position of a shielded connector.
Figure 21:
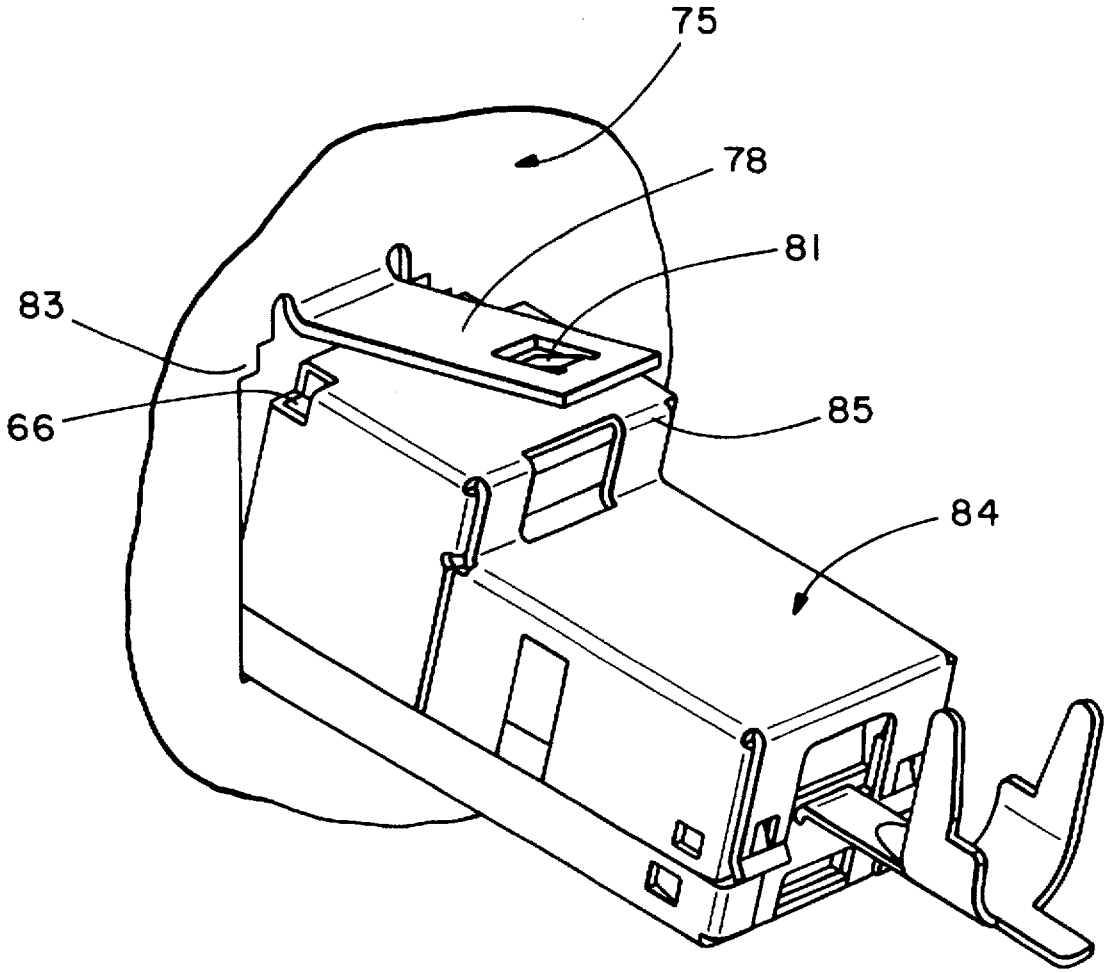
FIG. 21 is a fragmentary perspective view of the wall plate of FIG. 18 showing the initial connector insertion position of a shielded connector.
Figure 22:
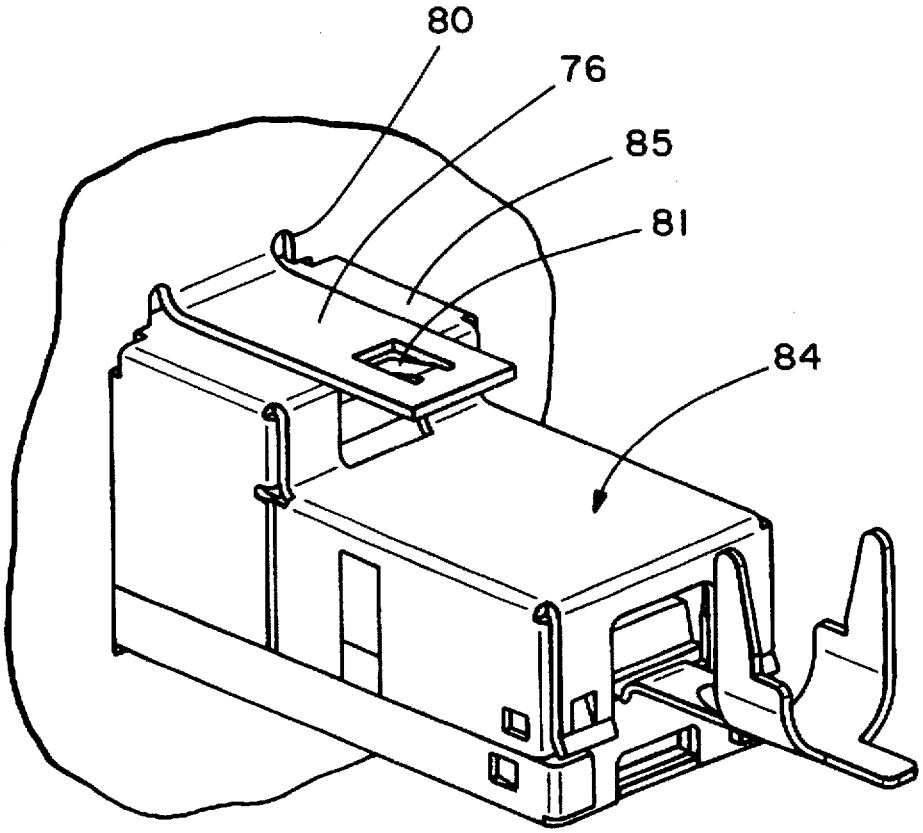
FIG. 22 is a fragmentary perspective view of wall plate of FIG. 18 showing the connector latched to the wall plate.
Figure 23:
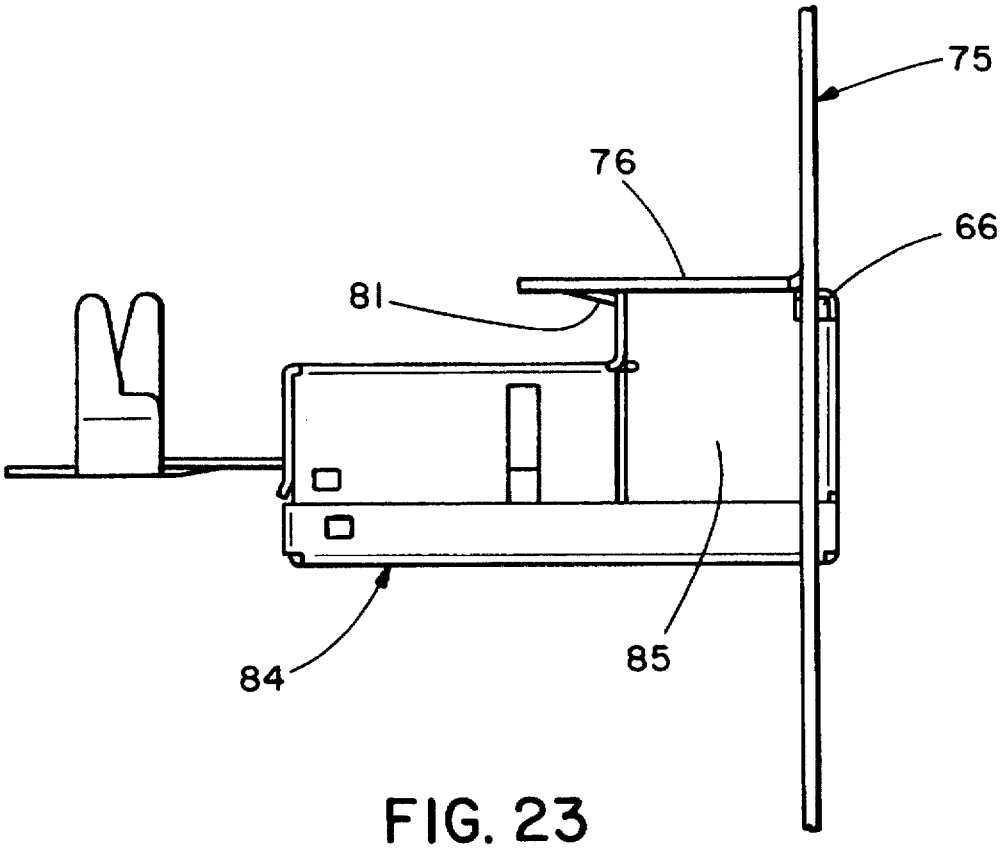
FIG. 23 is a fragmentary side view of the wall plate of FIG. 18 showing the connector latched to the wall plate.
Figure 24:
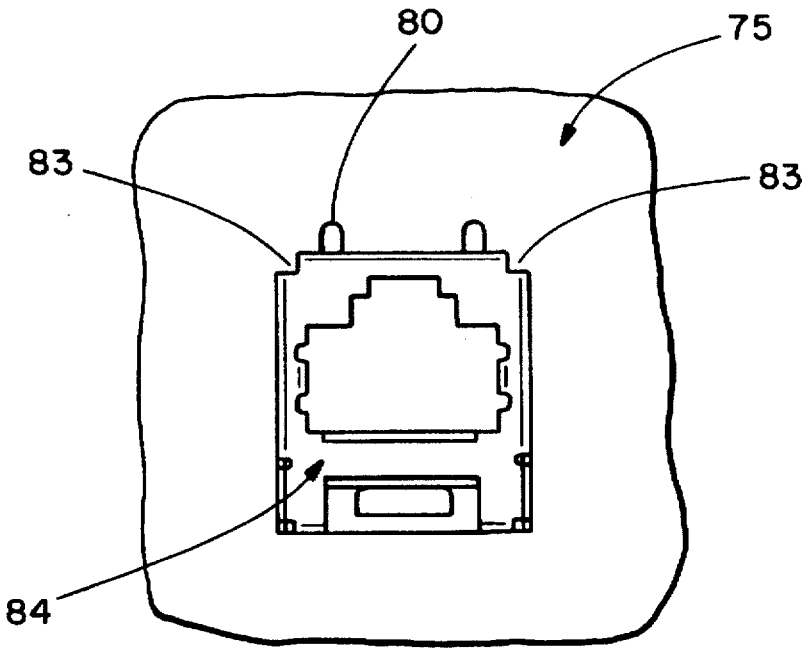
FIG. 24 is a fragmentary front view of the wall plate of FIG. 18 showing a connector latched to the wall plate.

A connector receptacle box assembly embodying the concept of the present invention is designated generally by the number 40 in the accompanying drawings. As seen in FIGS. 1–6, assembly 40 includes a one-piece plastic base 41 and a one-piece plastic cover 42. A modular communication connector 43, best seen in FIGS. 1 and 7–11, is configured to be releasably mounted within base 41. Connector 43 includes a modular plug accepting socket 44 formed in the front face of connector 43. Also medially positioned adjacent the lower edge of the front face of connector 43 is a rectangular front mounting slot 46 (FIG. 1), a rear mounting slot 48 (FIG. 11), a T-shaped central bottom mounting slot 50 having a centrally disposed notch 51 (FIG. 9). Connector 43 illustrates one type of connector configured to be mounted within the latching mechanism of the present invention although any type of connector, such as a coaxial connector, can be provided with latching features described herein for use in each respective embodiment of the present invention.

Base 41 includes a plurality of laterally adjacent connector mounting features, each of which includes a spaced apart and opposed front latch tooth 53 and rear latch tooth 54 which respectively are disposed to be received within front mounting slot 46 and rear mounting slot 48 of connector 43. Rear latch tooth 54 is medially disposed on a latch wall 55, projecting from wall 55 at a right angle. Latch wall 55 is integrally formed at a right angle at the end of a resilient cantilever arm 57 formed in the floor of base 41 by a slot 58 (see FIG. 2). Cantilever arm 57 and latch wall 55 resiliently position rear latch tooth 54 such that rear latch tooth 54 is resiliently cammed outwardly upon insertion of connector 43 into latching engagement with base 41. To latch connector 43 within base 41, front latch tooth 53 in base 41 is inserted into front mounting slot 46 in connector 43, and connector 43 is rotated downwardly past resilient rear latch tooth 54 which is cammed outwardly until it is aligned with rear mounting slot 48 of connector 43 and is resiliently biased inwardly into slot 48 (see FIG. 5). The design of the single resilient latch tooth. 53 formed on a latch wall 55 carried on a cantilever arm 57 integrally formed in a base 40 provides secure latching engagement of connector to base 41 and allows miniature connector modules to be easily removed from the base 41 merely by inserting a screwdriver between connector 43 and latch wall 55 and flexing wall 55 outwardly to disengage rear latch tooth 54 from rear mounting slot 48.

Figure 1:
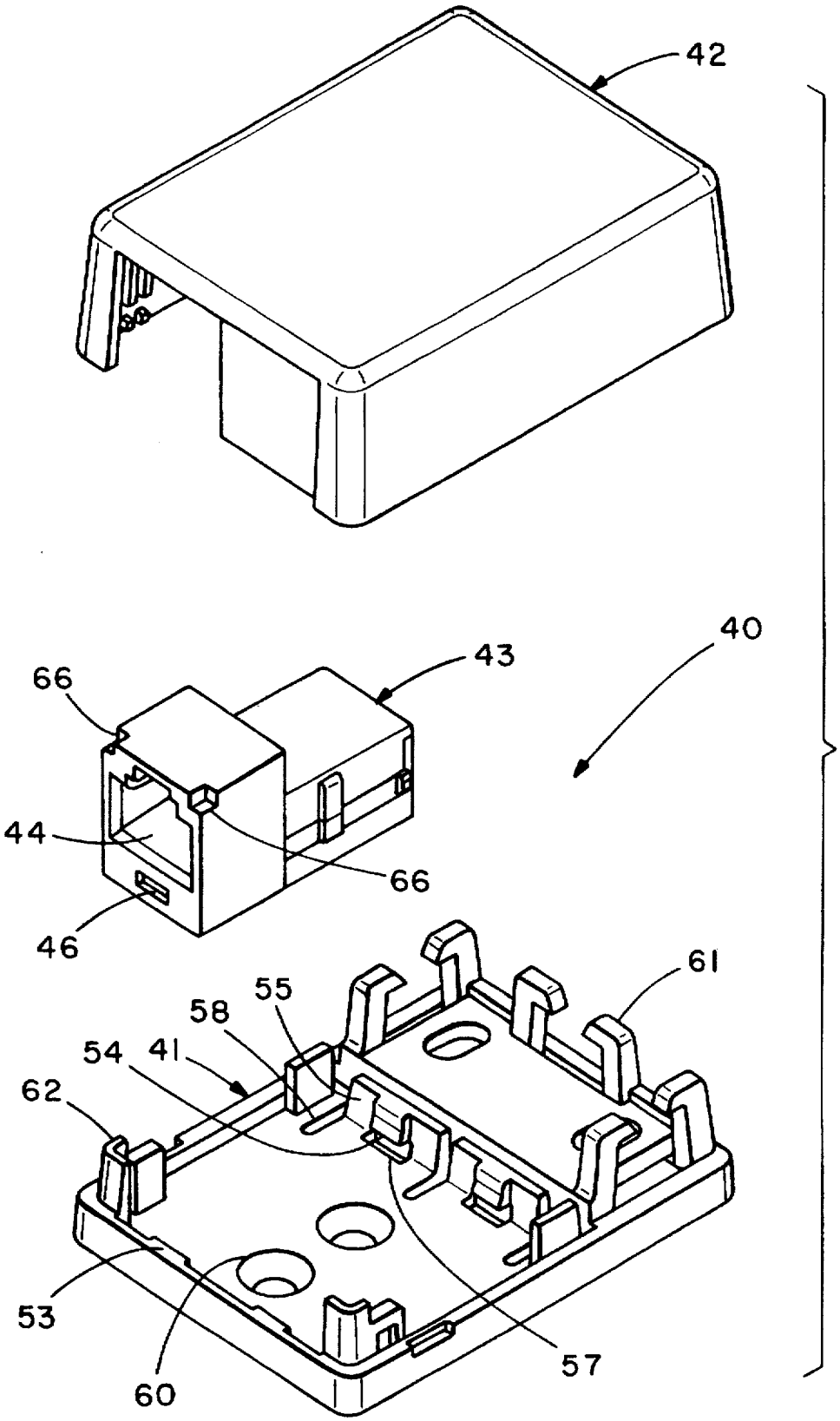
FIG. 1 is an exploded perspective view of a connector receptacle box assembly embodying the concept of the present invention.
Figure 2:
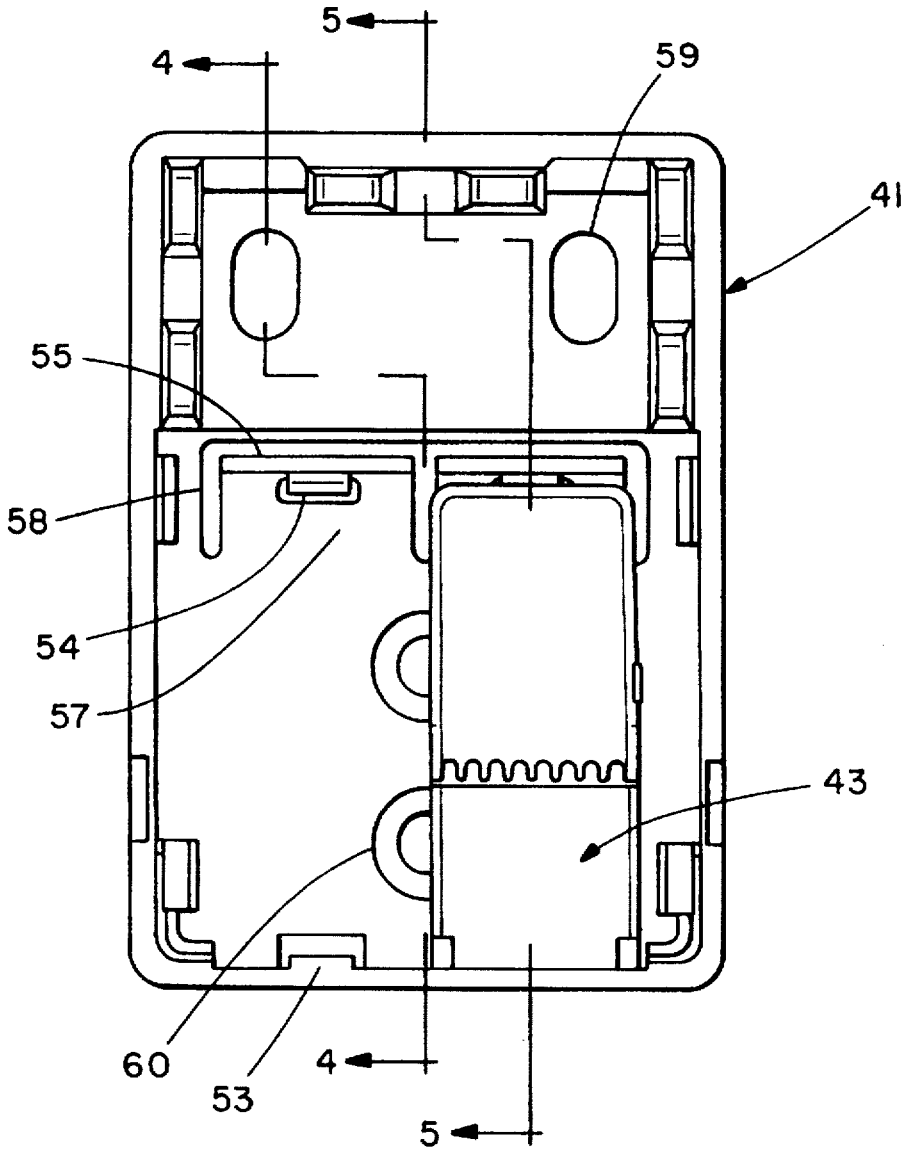
FIG. 2 is a top view of the base of the assembly of FIG. 1.
Figure 3:
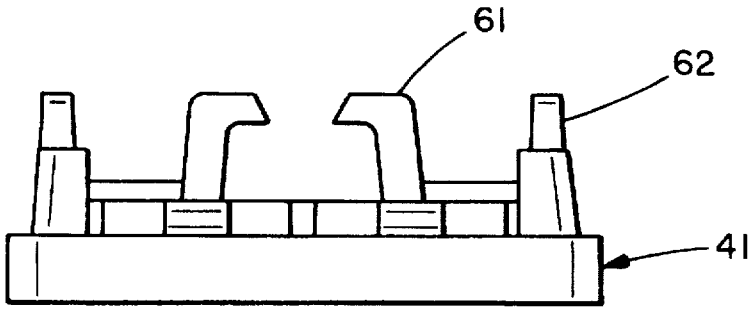
FIG. 3 is a front view of the base.
Figure 4:
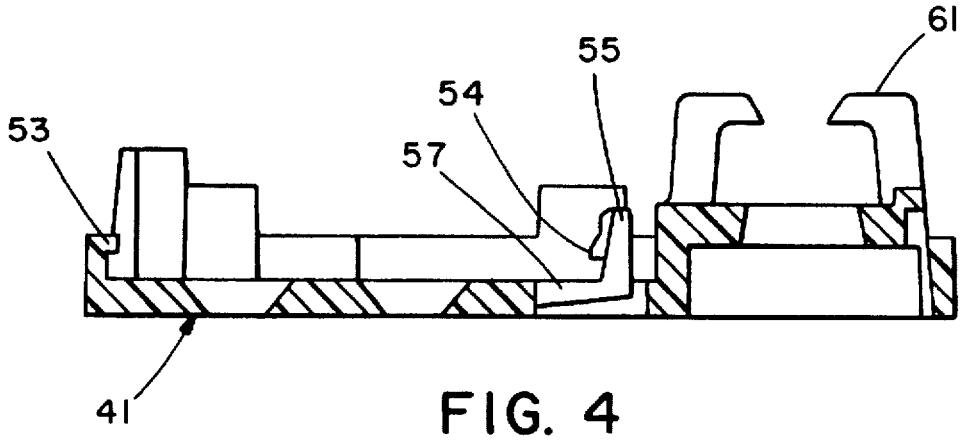
FIG. 4 is a sectional view taken along line 4—4 of FIG. 2.
Figure 5:
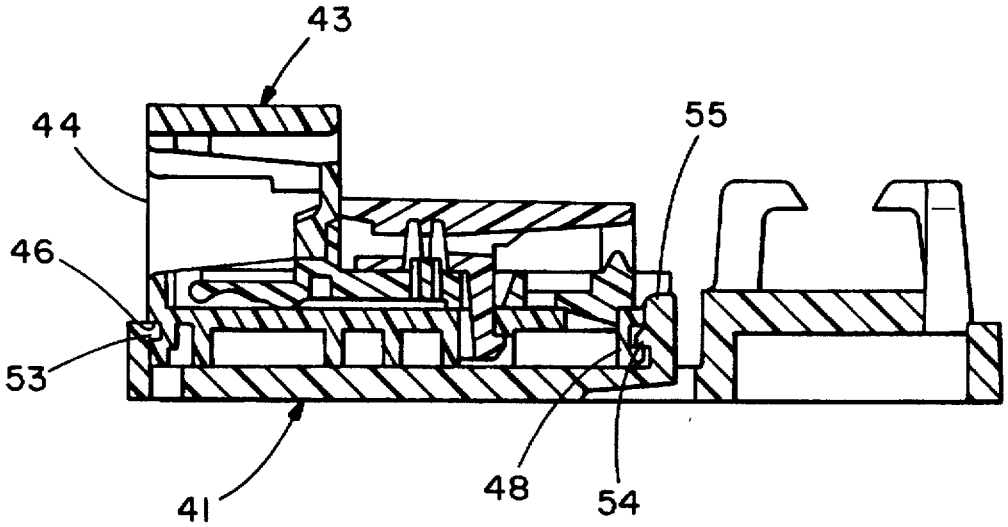
FIG. 5 is a sectional view taken along line 5—5 of FIG. 2.
Figure 6:
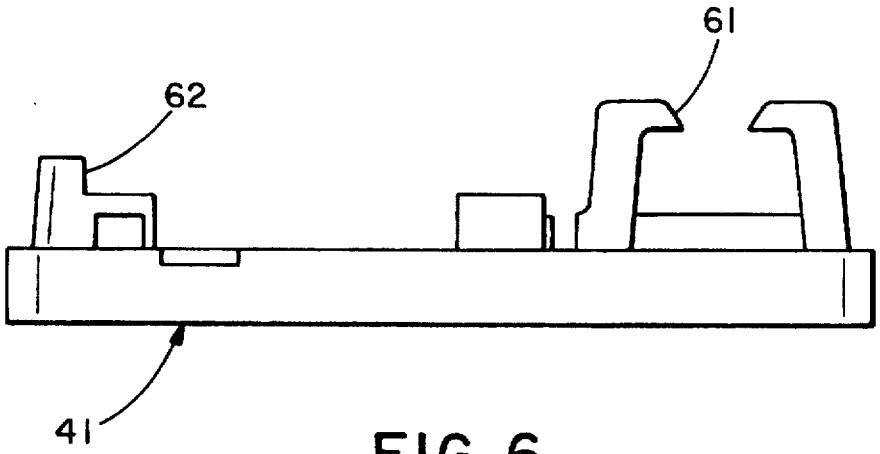
FIG. 6 is a side view of the base.
Figure 7:
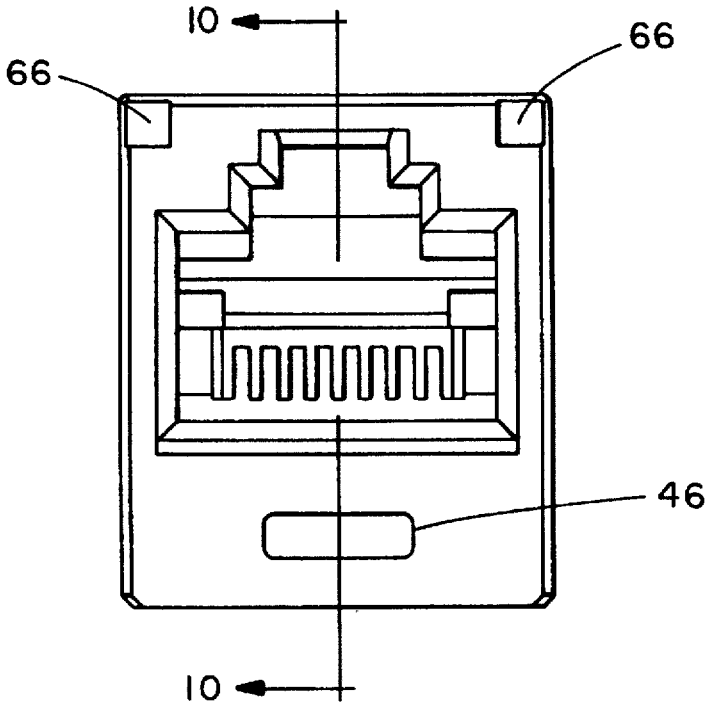
FIG. 7 is a front view of a modular connector.
Figure 8:
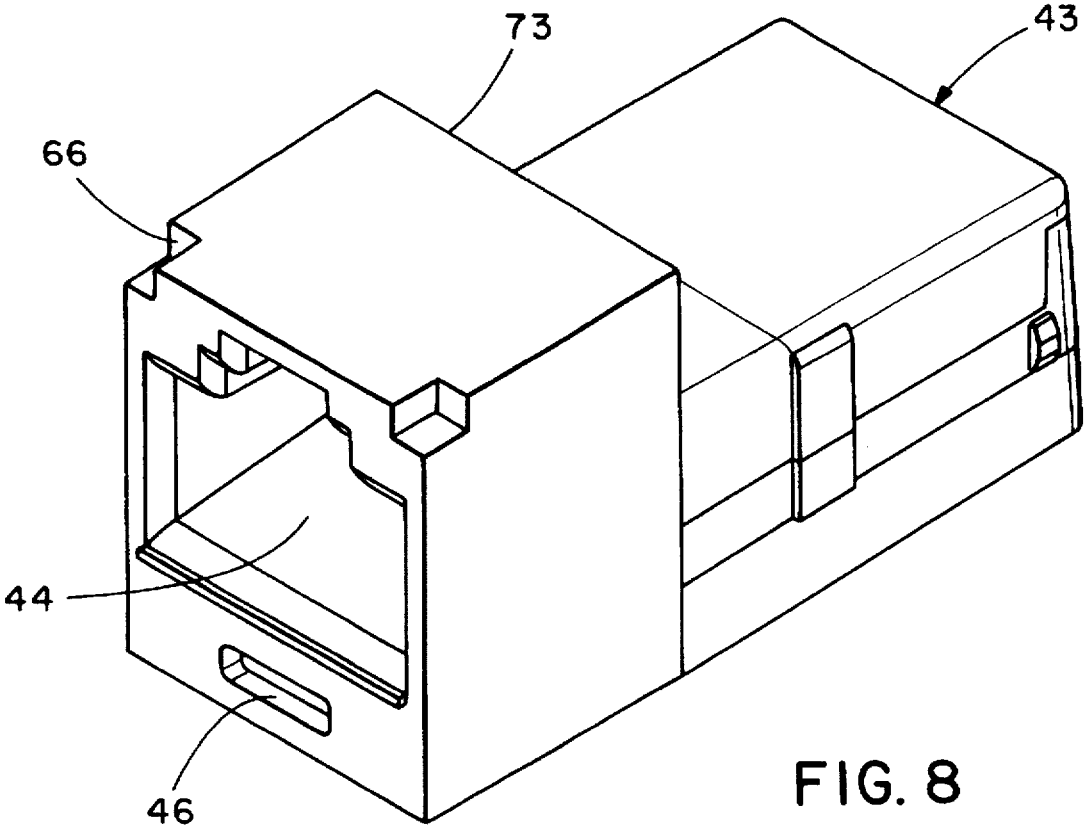
FIG. 8 is a perspective view of the connector of FIG. 7.

As seen in FIGS. 1 and 2, base 41 is also formed with wire access apertures 59, mounting holes 60, wire positioning guides 61, and cover alignment flanges 62 for engaging cover 42.

Another embodiment of the present invention, illustrated in FIGS. 12–17, is a one-piece plastic wall plate 65. Wall plate 65 is designed to removably latch to a plurality of connectors 43 to mount the connectors within a standard receptacle box. Connector 43, best seen in FIG. 1, includes corner slots 66 disposed to receive a lateral stop 67 and a lateral portion of a medial stop 68 formed on wall plate 65. Wall plate 65 includes a plurality of connector receiving apertures 69, each with two connector accepting positions, each position including a latching tooth 70 formed in a lower edge of aperture 69 opposite a resilient cantilever latch arm 71 having a barb 72 formed at its distal end. Lateral stops 67 and 68 are formed in the upper edge of each aperture 69 with latch arm 71 medially disposed there between. Together lateral stops 67 and 68 define stops in each lateral corner of the aperture for each connector mounting position. Connector 43 is mounted within wall plate 65 by inserting latching tooth 70 within notch 51 of central bottom mounting slot 50 (see FIG. 9) and rotating connector 43 upwardly to position a rear edge 73 (see FIG. 8) of connector 43 past barb 72 (FIG. 16) on resilient arm 71 of wall plate 65 and to position stops 67 and 68 within corner slots 66 of connector 43, securely latching connector 43 between stops 67 and 68 and barb 72, with latching tooth 70 preventing forward movement of the bottom edge of connector 43.

For certain applications it is desirable to mount shielded modular connectors to a grounded wall plate or patch panel. Shielded connectors are made with a metal case that encloses the outer surface of the connector.

An alternative embodiment of the invention is illustrated in FIGS. 18–24 as a one-piece metal wall plate 75. Wall plate 75 is formed of stainless steel with a planar cantilever latch arm 76 formed perpendicular to the plane of wall plate 75 along an upper edge of a connector accepting opening 77. Formed opposite arm 76 is a medially disposed tooth 79 disposed to engage second central bottom mounting slot 50 in connector 43. Slots 80 formed in wall plate 75 laterally adjacent to arm 76 provide additional resiliency to arm 76. Latch arm 76 includes a barb 81 medially formed in the distal end of arm 76 and disposed to engage rear edge 73 of connector 43. Lateral stops 83 are formed along the upper edge of opening 77.

A shielded connector 84 which is constructed to include the same mounting slots of connector 43 is illustrated in FIGS. 20–24 enclosed within a metal shield 85. Shield 85 of connector 84 engages the metal edges of metal wall plate 75 and resilient latch arm 76 to conductively connect connector shield 85 to wall plate 75 to automatically provide a ground between shield 85 and wall plate 75 when shielded connector 84 is latched to wall plate 75.

As seen in FIGS. 20–23, connector 84 is latched to wall plate 75 by positioning tooth 79 within central bottom mounting slot 50 (not shown) and rotating connector 61 into engagement with barb 81 of latch arm 76 with lateral stops 83 positioned within corner slots 66.

Figure 25:
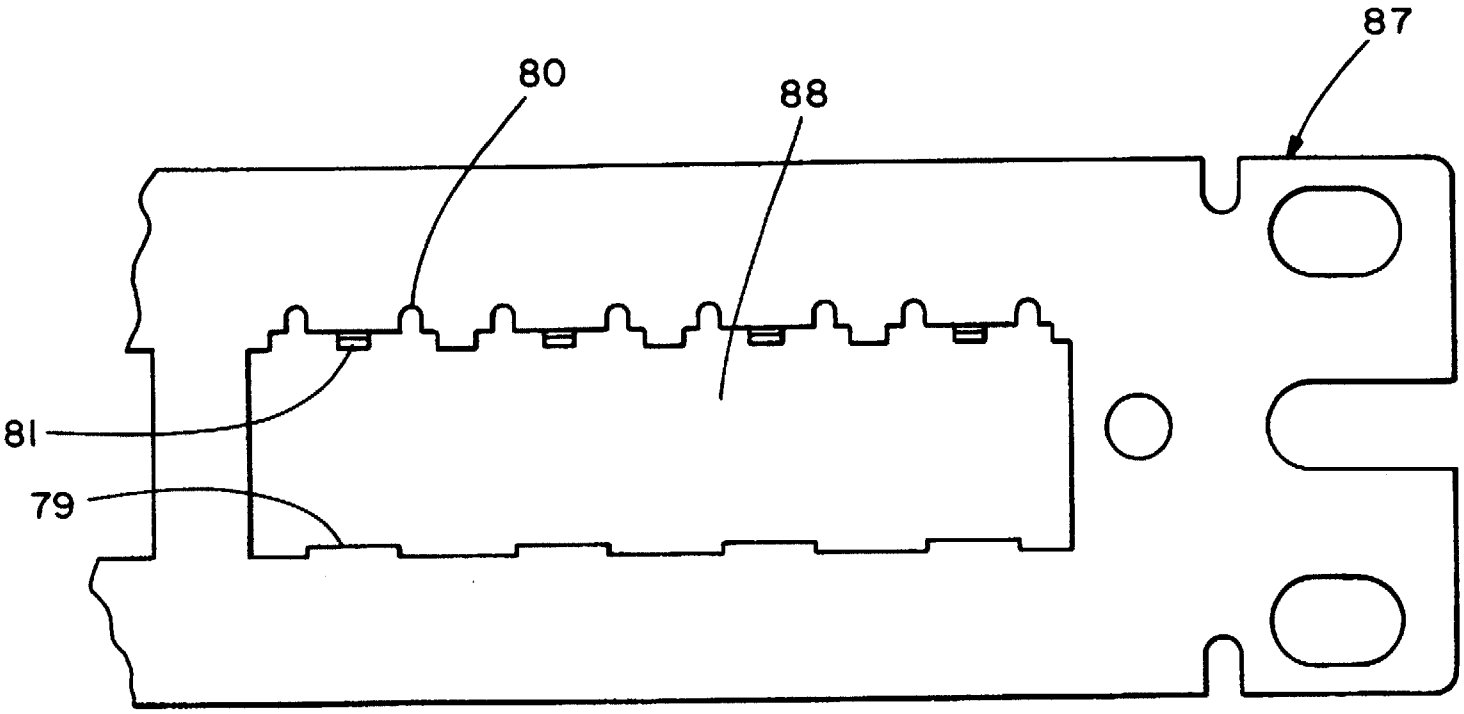
FIG. 25 is a fragmentary front view of a patch panel having the same connector latching structure of the wall plate of FIG. 18.
Figure 26:
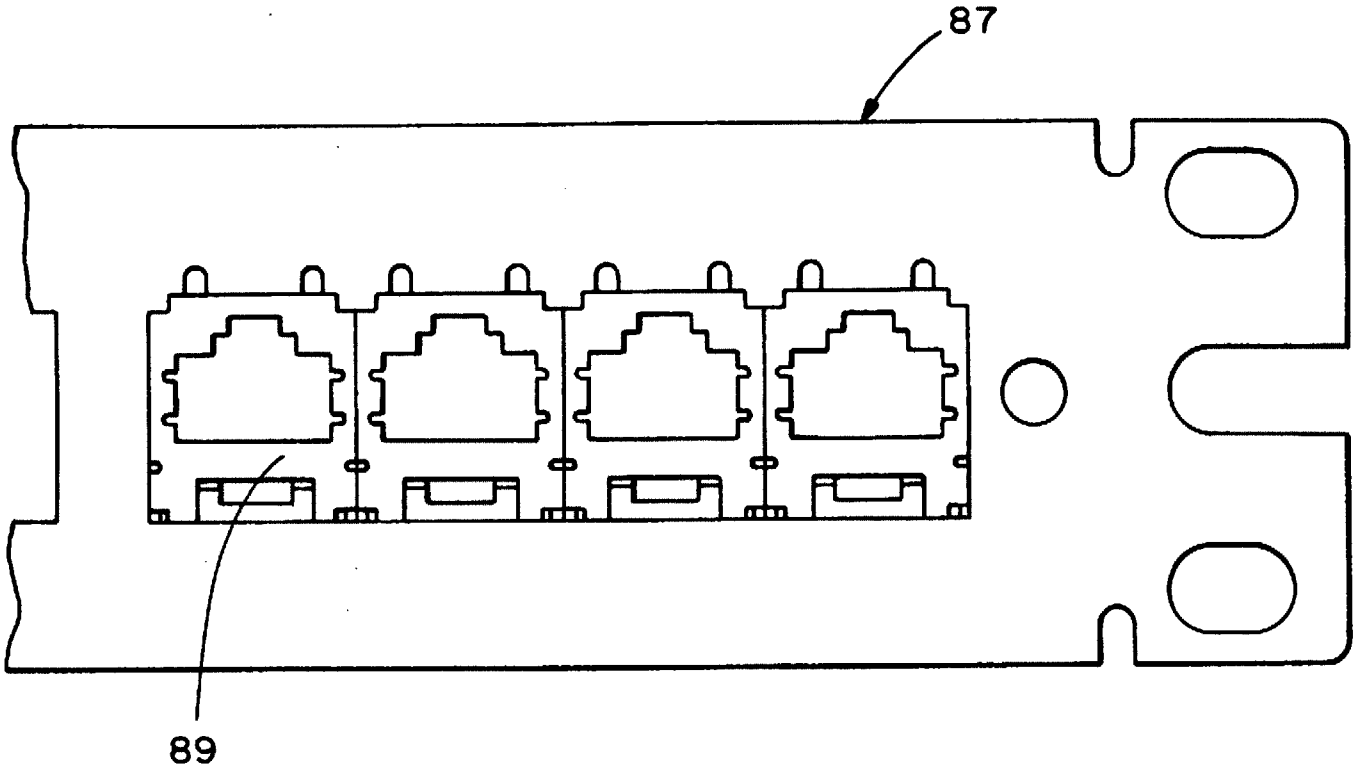
FIG. 26 shows connectors latched to the patch panel of FIG. 25.
Figure 27:
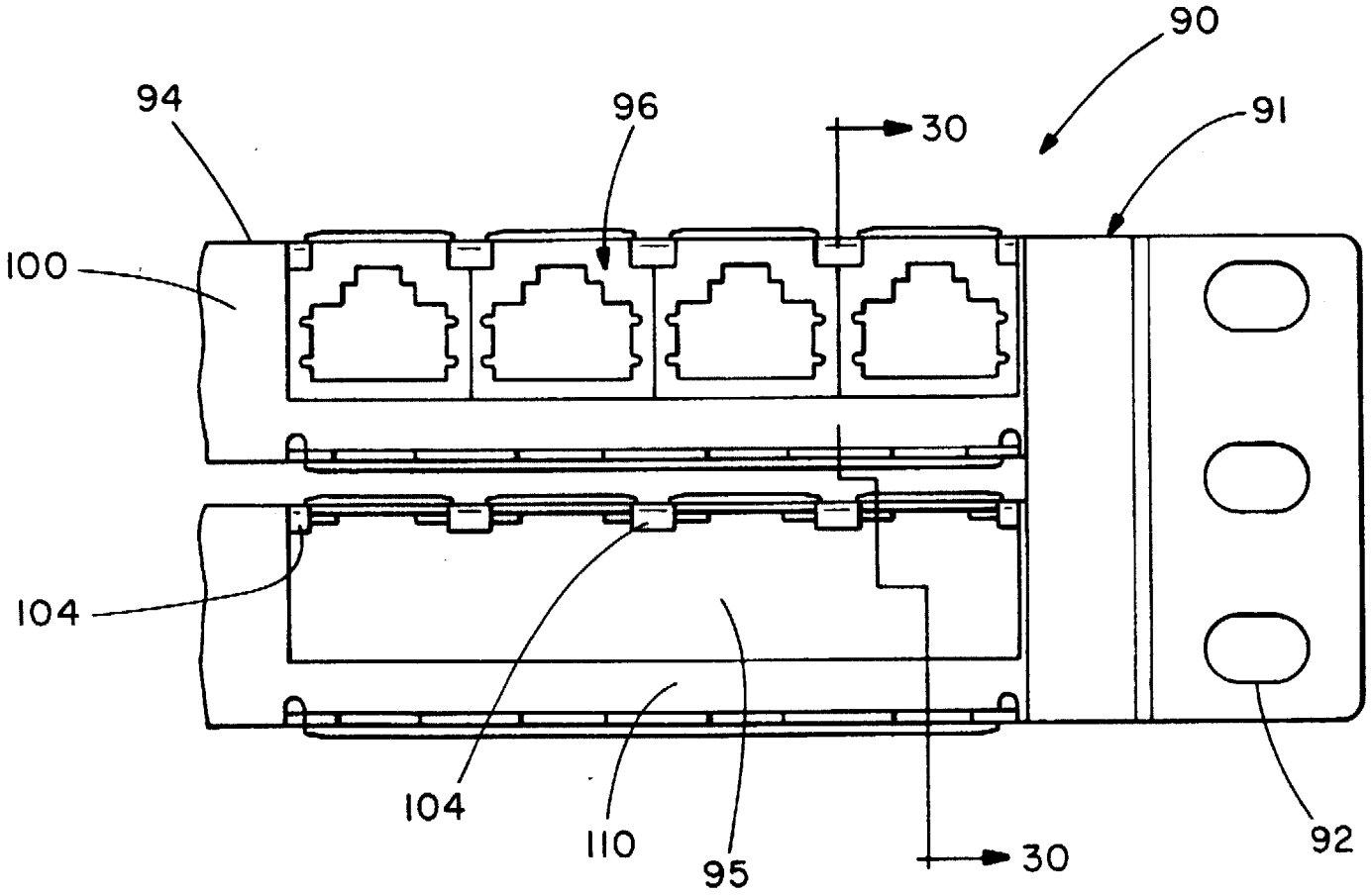
FIG. 27 is a fragmentary front view of a high density patch panel connector receptacle embodying the concept of the present invention.

FIGS. 25 and 26 illustrate a portion of a steel patch panel 87 having identical connector mounting features of FIGS. 18–24 disposed to individually mount four shielded connector modules. Patch panel 87 is typically provided with six connector module mounting apertures 88, each mounting four connectors 89.

Figure 30:
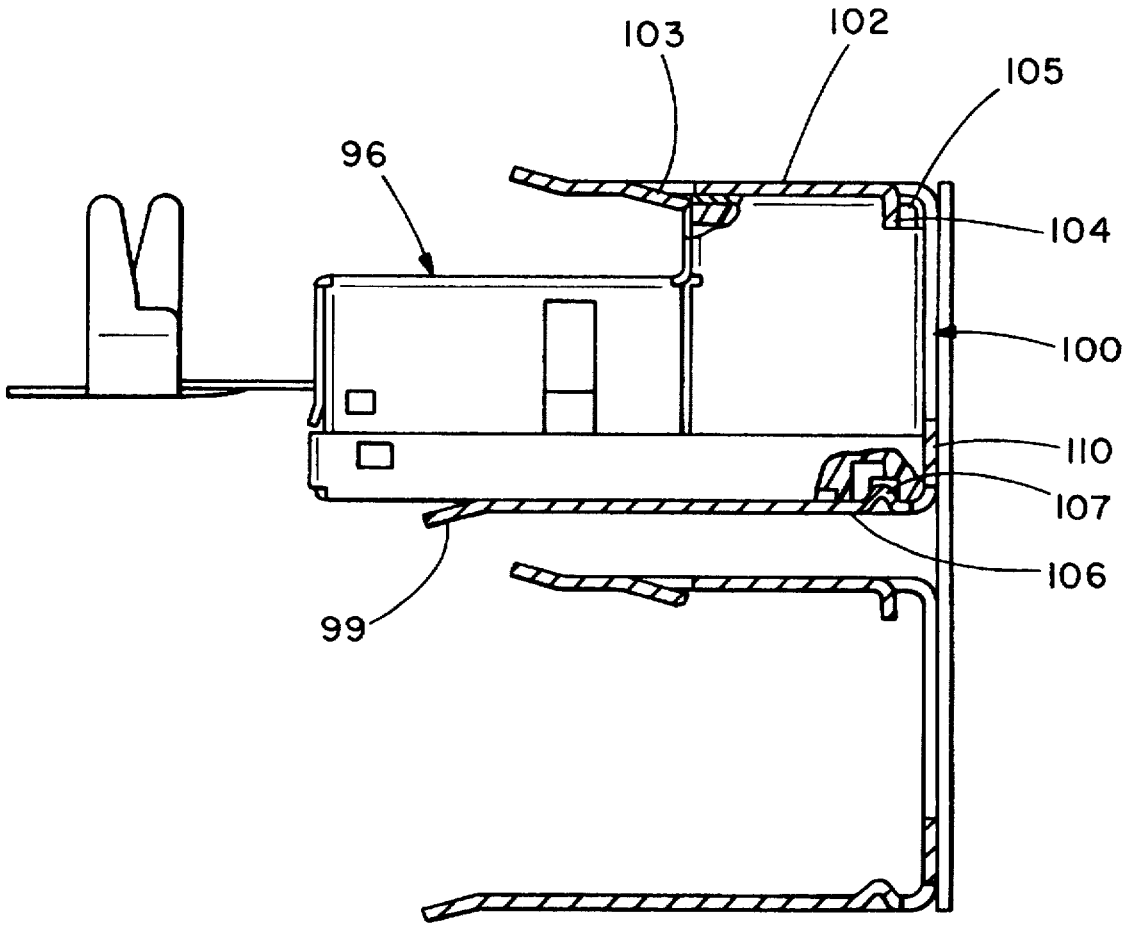
FIG. 30 is sectional view taken along line 30—30 of FIG. 27.
Figure 31:
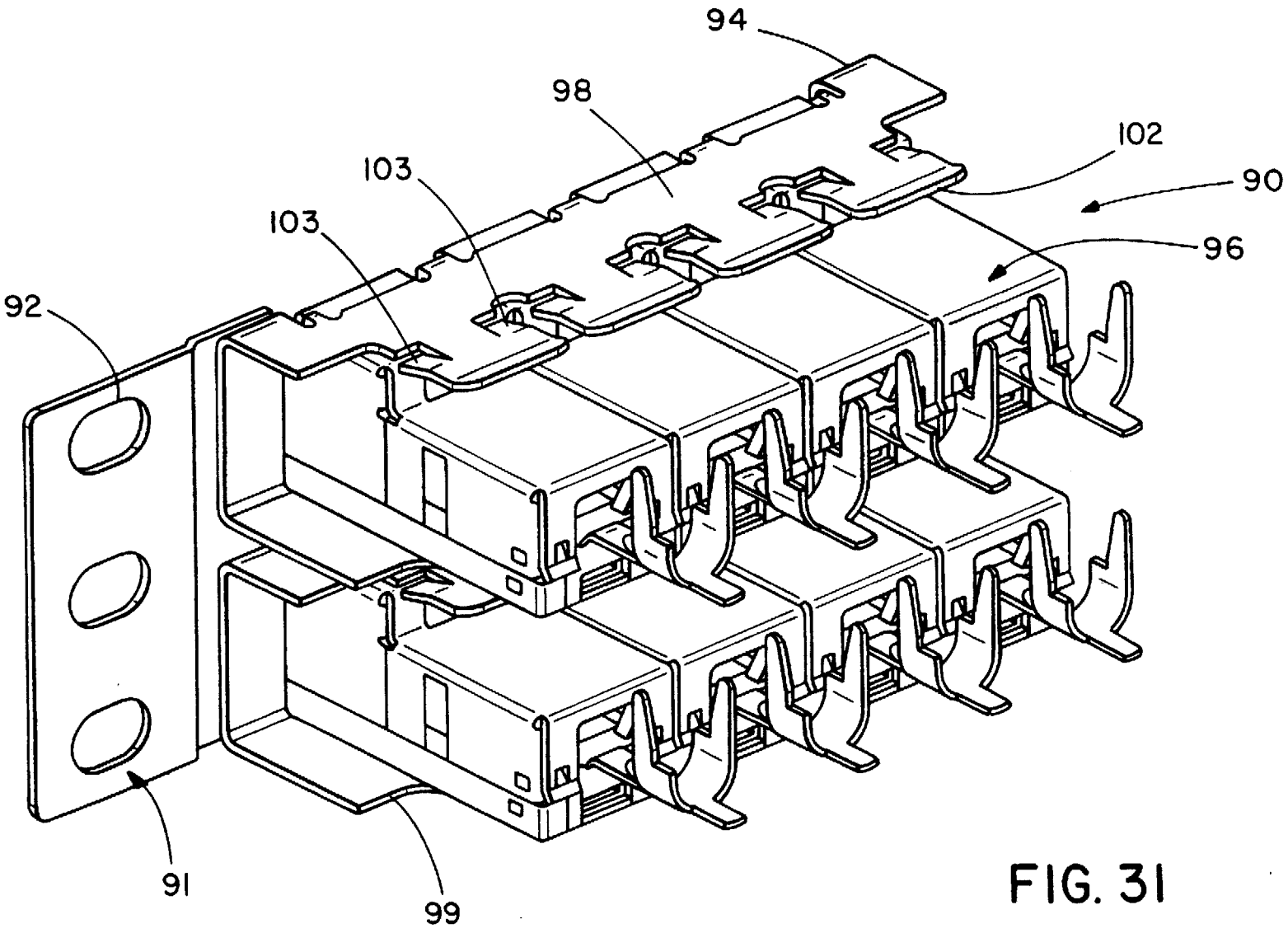
FIG. 31 is a fragmentary rear perspective view of the high density patch panel of FIG. 27.
Figure 32:
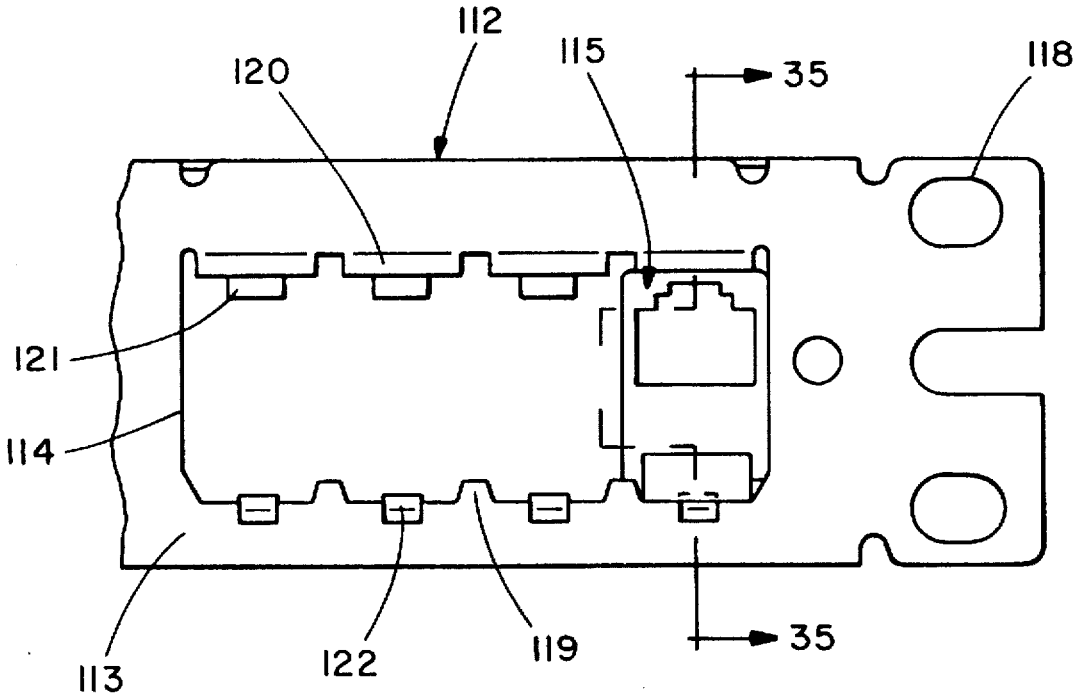
FIG. 32 is a fragmentary front view of a patch panel connector receptacle embodying the concept of the present invention.
Figure 33:
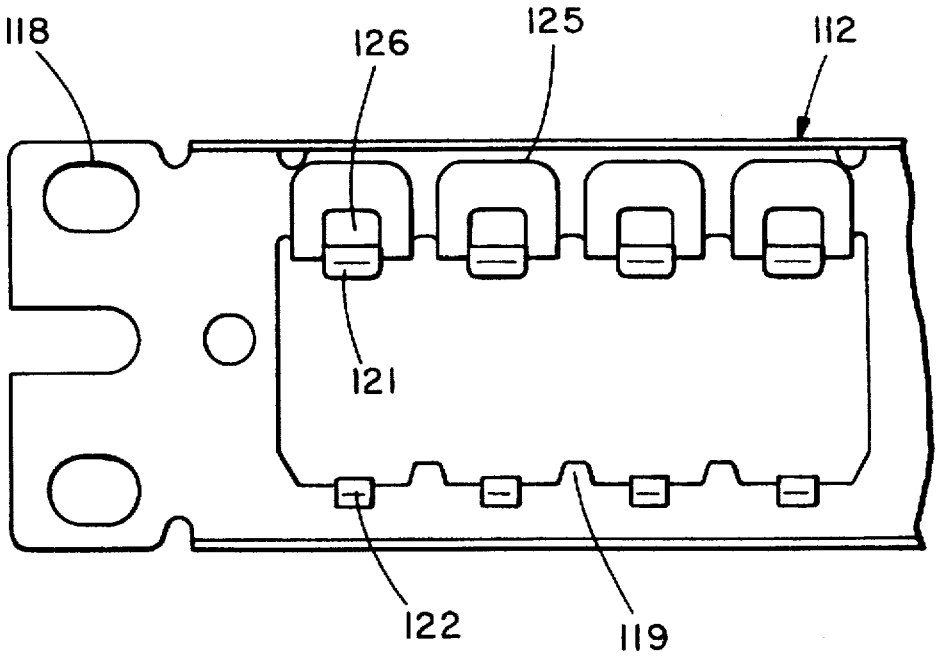
FIG. 33 is a rear view of the patch panel of FIG. 32.
Figure 34:
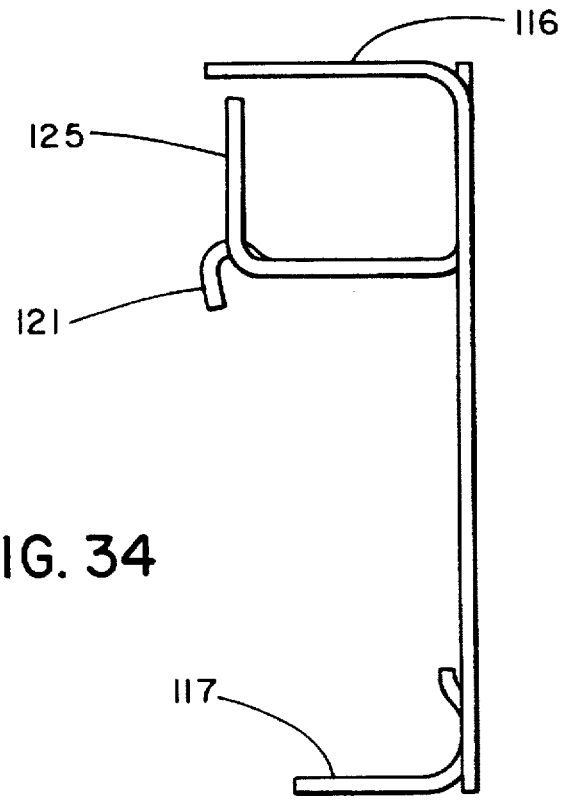
FIG. 34 is a side view of the patch panel of FIG. 32.

Another embodiment of the present invention, illustrated in FIGS. 27–31, is a high density modular connector-patch panel receptacle 90. As best seen in FIG. 31, receptacle 90 includes a mounting bracket 91 having mounting holes 92 for attachment of the receptacle 90 to a patch panel mounting frame. A bracket 91 is welded to two identical connector C-channel mounting strips 94 on either side of receptacle 90, with only the left bracket 91 and a first segment of connector mounting strips of 94 of receptacle 90 illustrated in FIG. 31. The first segment of each strip is formed with an aperture 95 (FIG. 27) configured to mount four modular shielded connectors 96.

Each connector mounting strip 94 is integrally formed of stainless steel with upper and lower cantilever flanges 98 and 99 formed at opposing edges of a face portion 100 to form a C-shaped cross section, as seen in FIG. 31. The C-shape cross section provides the required stiffness in the mounting strip which typically extends to accommodate 24 connectors in repeating four connector segments. Face portion 100 is formed with aperture 95 that preferably is configured to accept four connectors 96.

Figure 28:
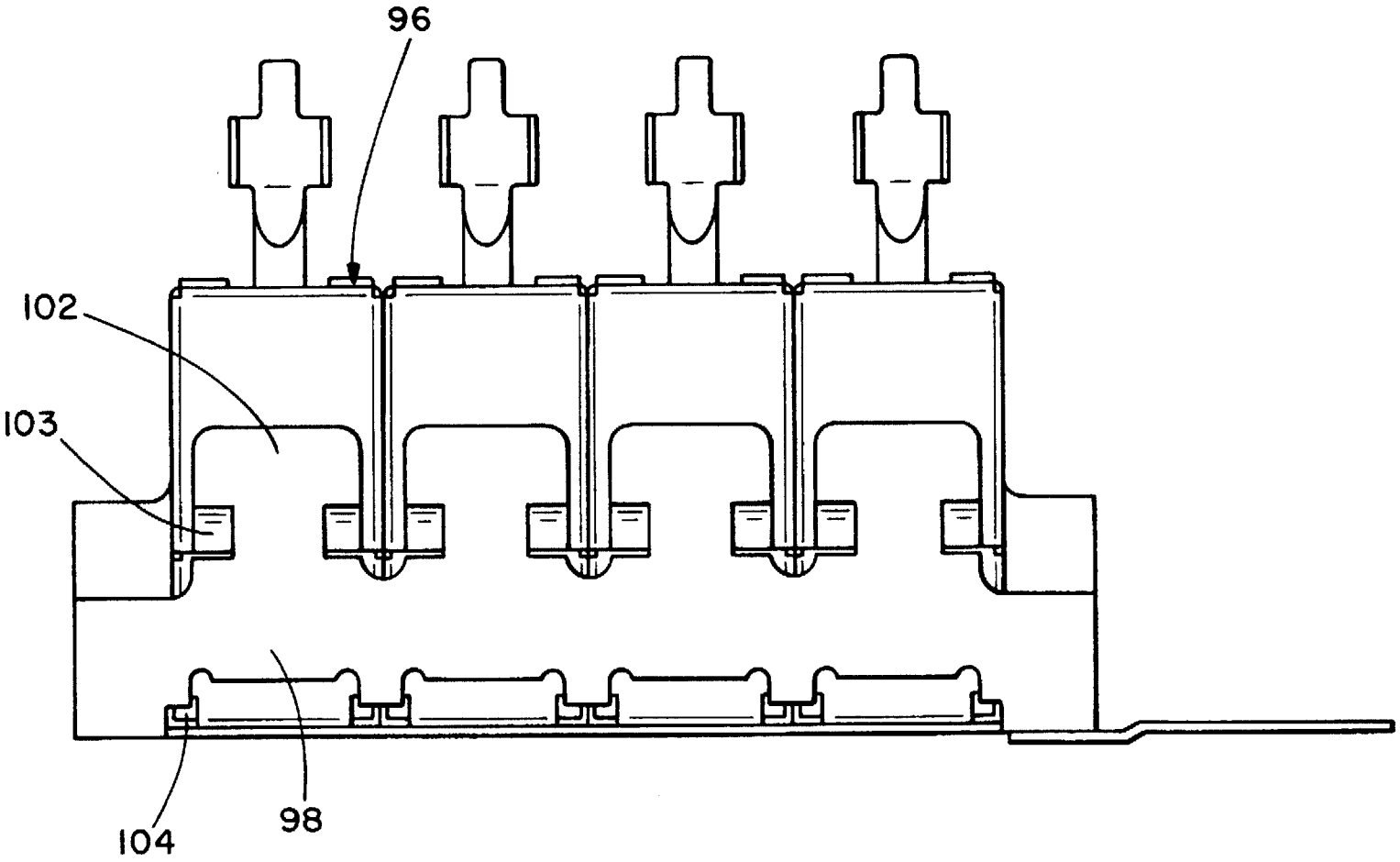
FIG. 28 is a fragmentary top view of one of the connector mounting strips of the patch panel of FIG. 27.
Figure 29:
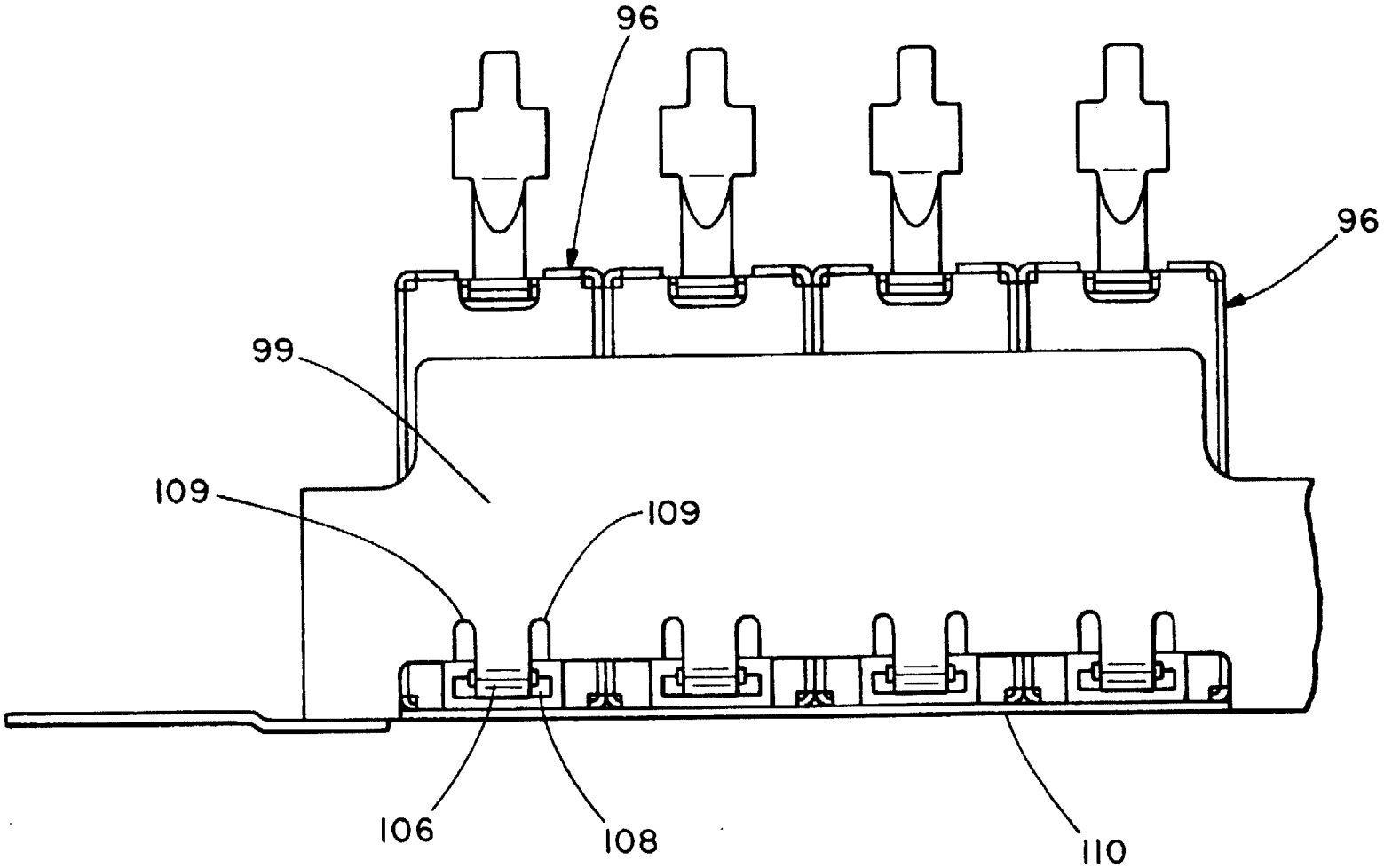
FIG. 29 is a fragmentary bottom view of one of the connector mounting strips of the patch panel of FIG. 27.

As seen in FIGS. 28 and 30, upper flange 98 includes a plurality of resilient cantilever latch arms 102 each having a pair of latch barbs 103 formed on opposing lateral edges of each arm 102, barbs 103 being disposed to engage a rear edge of connector 96. Also formed on upper flange 98, aligned with each latch arm 102 is a pair of spaced apart stops 104 disposed to engage corner slots 105 in the front face of connector 96. Lower flange 99 includes a resilient cantilever latch 106 having a V-shaped tooth 107 (see FIG. 30) disposed to latch within a central mounting slot 108 in the bottom of connector 96. Cantilever latch 106 is defined by slots 109 formed in lower flange 99 (see FIG. 29). Lower flange 99 extends a substantial portion of the length of connector 96 and acts as a connector positioning platform. A bottom stop portion 110 of face 100 extends above lower edge of connectors 96 and acts as a lower stop. Connector 96 can be released from receptacle 90 by disengaging latch barbs 103 and withdrawing the connector, with cantilever latch 106 being sufficiently resilient to cam out of engagement with the connector upon withdrawal.

Figure 35:
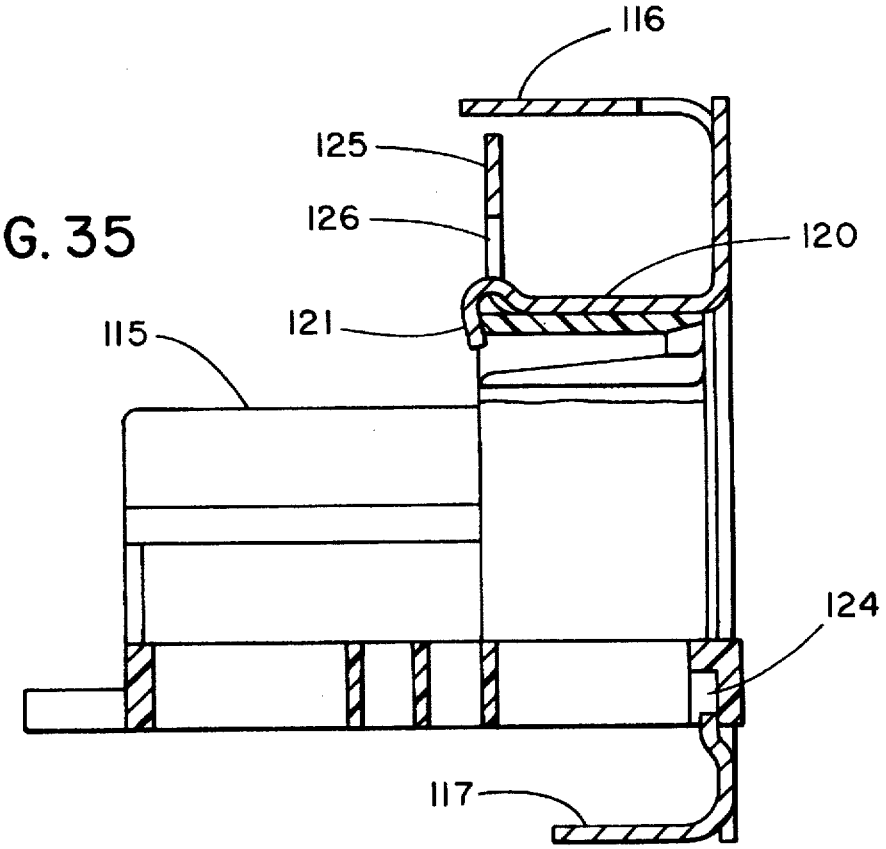
FIG. 35 is a sectional view taken along line 35—35 of FIG. 32.

Another embodiment of the present invention, illustrated in FIGS. 32–38, is a stainless steel modular connector patch panel receptacle 112. Receptacle 112 includes a face portion 113 having an aperture 114 configured to releasably mount four connectors 115, as seen in FIG. 35. Connector 115 is a modular telephone connector as described in U.S. Pat. No. 5,118,310, which is incorporated herein by reference. Typically six apertures 114 are formed in each patch panel receptacle 112. Upper an lower flanges 116 and 117 are formed perpendicular to face portion 113 to provide structural rigidity to receptacle 112. Mounting holes 118 are formed at either end of receptacle 112.

Connector 115 is mounted to receptacle 112 by cantilever latch 120 that is formed with a hook-shaped tooth 121 disposed to engage a rear edge of connector 115 and by an opposing tooth 122 medially formed in an opposite edge of aperture 114. Latch 120 projects substantially perpendicular to face 113 of receptacle 112 and is sufficiently long and disposed relative to connector 115 to resiliently engage the top surface of connector 115 and prevent forward movement of connector 115 out of receptacle 112.

Tooth 122 is inset inwardly from face 113 and is disposed to be inserted into a central mounting slot 124 in connector 115 to prevent inward movement of the bottom of connector 115. Outward movement of the bottom edge of connector 115 is prevented by lateral bottom stops 119 (see FIG. 32), disposed in the plane of face 115, that are positioned to interfere with the lower edge of connector 115.

Figure 36:
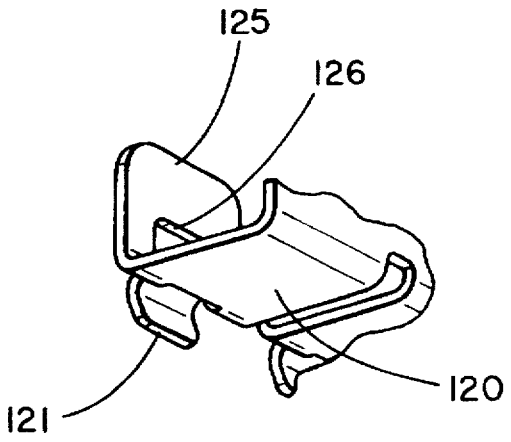
FIG. 36 is a fragmentary front, perspective view of a connector latch of the patch panel of FIG. 32.
Figure 37:
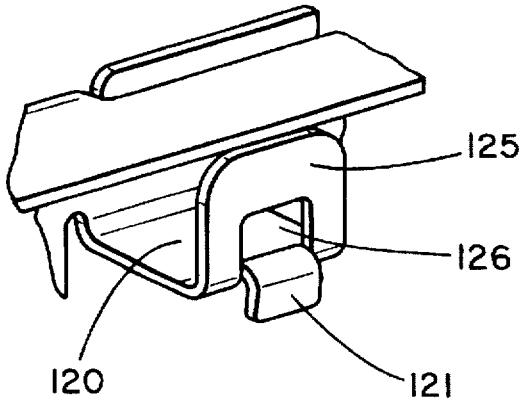
FIG. 37 is a fragmentary rear perspective view of a connector latch of the patch panel of FIG. 32.
Figure 38:
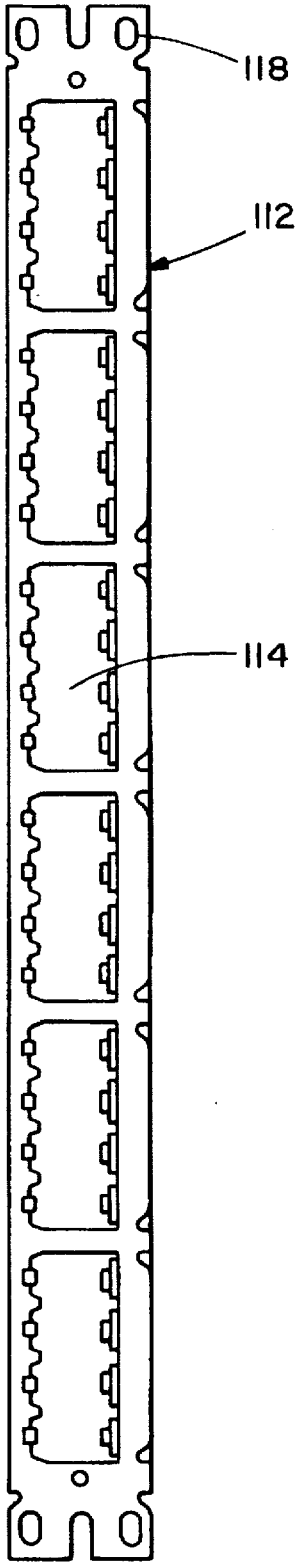
FIG. 38 is a front view of the patch panel of FIG. 32.

As best seen in FIGS. 36 and 37, cantilever latch 120 includes a C-shaped release tab 125 integrally formed at the end of latch 120, which defines a tool accepting aperture 126 that allows easy release of latch 120 to remove a mounted connector from receptacle 112 by inserting a screw driver within aperture 126 and disengaging tooth 121 from connector 115.

While the particular preferred embodiments of the present invention have been shown and described, it will be obvious to those skilled in the art that changes and modifications may be made without departing from the teachings of the invention.

We claim:

1. A receptacle for mounting a modular connector having front and rear mounting slots disposed on front and back surfaces of the connector, comprising:

a planar base;

latch means integrally formed in the base for releasably securing the connector to the base including;

a front latch tooth formed in the base disposed to engage the front mounting slot of the connector, a resiliently mounted rear latch tooth formed on a latch wall and aligned with and spaced from the front latch tooth such that the rear latch tooth is disposed to engage the rear mounting slot of the connector secured by the latch means, the latch wall formed perpendicular at the end of a resilient cantilever base arm formed in the plane of the base, wherein the rear latch tooth is disposed to resiliently latch the connector to the base such that the connector can be released from the base by depressing the cantilever base arm, which rotates the latch wall and latch tooth away from the connector to disengage the rear latch tooth from the rear slot in the connector.

2. A receptacle as set forth in claim 1, wherein the cantilever base arm is defined in the base by a slot formed in the base therearound.

* * * * *

UNITED STATES PATENT AND TRADEMARK OFFICE

CERTIFICATE OF CORRECTION

PATENT NO. : 5,738,539

DATED : April 14, 1998

INVENTOR(S) : Caveney et al.

It is certified that error appears in the above-identified patent and that said Letters Patent is hereby corrected as shown below:

On the title page, item [75], Dale Alan Block, Karl Erik Falkstrom, Kris B. Lindley and Michael Joseph McGrath should be deleted.

Signed and Sealed this

Thirty-first Day of August, 1999

*Attest:*

Q. TODD DICKINSON

*Attesting Officer*

*Acting Commissioner of Patents and Trademarks*